US006880547B2

(12) United States Patent
Bilodeau

(10) Patent No.: US 6,880,547 B2
(45) Date of Patent: Apr. 19, 2005

(54) WOOD BURNING SWIMMING POOL HEATER

(76) Inventor: Sylvain Bilodeau, LS Bilodeau Inc, 275 route 108, St-Éphrem, Québec (CA), G0S 3H0

( * ) Notice: Subject to any disclaimer, the term of this patent is extended or adjusted under 35 U.S.C. 154(b) by 0 days.

(21) Appl. No.: 10/448,648

(22) Filed: May 29, 2003

(65) Prior Publication Data

US 2004/0226554 A1 Nov. 18, 2004

(51) Int. Cl.[7] ..... F24D 9/00

(52) U.S. Cl. ..... 126/101; 126/350.1; 122/16.1; 122/18.3; 122/363.3

(58) Field of Search ..... 126/101, 70, 350.1, 126/361.1; 122/16.1, 163, 18.3, 14.3, 367.3, 367.1, 14; 4/493; 110/234

(56) References Cited

U.S. PATENT DOCUMENTS 1,682,029 A * 8/1928 Barrett ..... 126/379.1
2,084,990 A * 6/1937 Burghardt et al. ..... 122/135.1
2,277,340 A * 3/1942 Thomas ..... 126/70
4,127,107 A * 11/1978 Melgeorge ..... 122/14.2
4,582,043 A * 4/1986 Walker et al. ..... 126/101
4,662,350 A * 5/1987 Mossbach ..... 126/101
5,809,942 A * 9/1998 Kralovec et al. ..... 122/235.14

* cited by examiner

*Primary Examiner*—James C. Yeung

(57) ABSTRACT

A swimming pool heater that heats a private swimming pool and can be used to provide heating for a house, a cottage or a commercial swimming pool. Wood, that is often found around pools, is used as primary fuel. This oven has a cylindrical external appearance and is disposed horizontally. It is made of an interior wall and an exterior wall in between which water circulates. The interior wall plays the role of fire chamber and heat exchanger; the section having the shape of an annular zig-zag offers more surface for heat exchange than a simple cylinder thus increasing the overall heater efficiency. The left-over ashes insulate the bottom of the heating chamber replacing often used tiles. For general use, logs and branches are used as fuel, and an increase of 20 to 30 degrees F. of the water of a typical garden pool is attained overnight.

4 Claims, 9 Drawing Sheets

WOOD BURNING SWIMMING POOL HEATER

BACKGROUND OF THE INVENTION

1. Field of the Invention

This invention is related to the field of water heaters, particularly those which are used as means to heat the water of outdoor swimming pools and use wood as primary fuel.

2. Description of the Prior Art

The objective of the inventor was to provide a practical means of heating pools. Originally from Quebec, this invention can make use of wood, an abundant natural resource which is often found near pools in most backyards due to the frequent use of wood for heating homes in winter. The inner wall and general design have been optimized to provide a high water heating efficiency and to be easily adaptable to most exterior pools.

OBJECTS OF THE INVENTION

It is a general objective of the inventor to provide a swimming pool water heater, the invention can be used for the heating of water in many other applications which can include water based heating of homes or cottages. Another objective is to make use of the wood which is already present around many pools, therefore using branches and slim logs, four feet long or shorter, to maintain typical pool water 20 to 30 degrees F. higher than it would be otherwise. Yet another objective is to use the ashes Left behind from the combustion of the wood, as an insulator between the fire and the bottom portion of the fire chamber.

A further objective is to provide an oven with a horizontal cylinder external shape, and to provide within the outside cylinder a corrugated fire chamber. Water circulates and is heated in the region between the two surfaces. The corrugated fire chamber wall provides a large heat exchange surface between the fire and the water and is typically of star shaped cross section. The particular shape of the cross section is to provide a heat exchange surface which is greater than the surface of a non-corrugated surface having the same external diameter. The greater surface of heat exchange is to increase the heat transfer across the inner wall, therefore increasing the heater's overall efficiency.

BRIEF DESCRIPTION OF THE DRAWINGS

In the accompanying drawings, forming a part of this specification, similar reference characters identify corresponding parts through the several, views.

DESCRIPTION OF THE PREFERRED EMBODIMENT

1. Detailed Description of the Drawings

In the following description, the numerals refer to specific items displayed in the figures.

Figure 1:
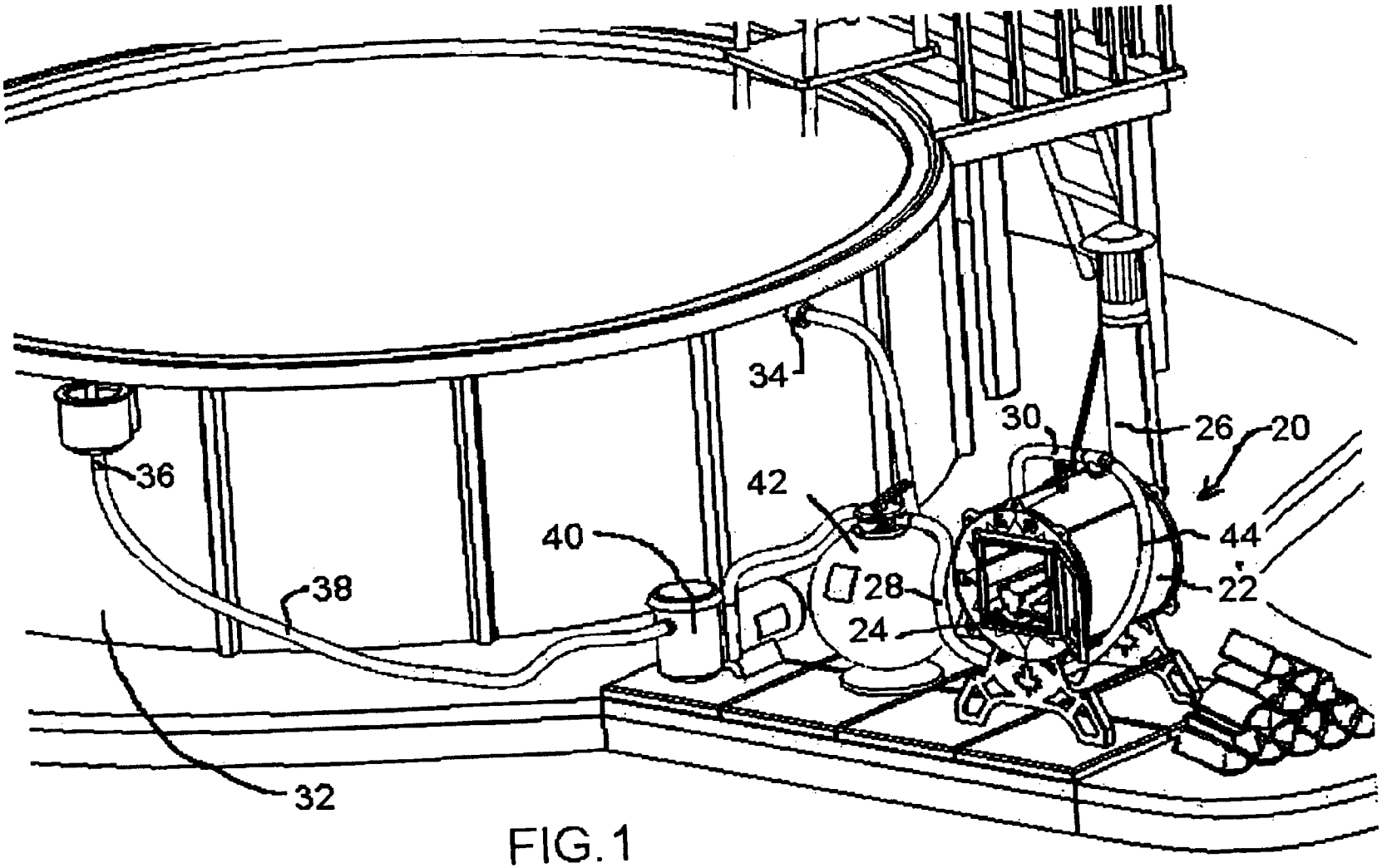
FIG. 1 is an overall view showing the elements of the pool heater forming one embodiment of the invention.

FIG. 1 shows a pool heater 20 indicated by means of an arrow. An oven 22 is shown which has an opening 24 in the front for the loading of a fuel like wood. The pool heater also comprises a chimney 26 towards the rear of the oven, a water inlet 28 which brings water in from the pool 32, an outlet 30 which sends heated water back to the pool. The pool intake can comprise different means to increase water mixing and pumping efficiency. In the case illustrated, the heater uses the standard pool input 34 and output 36, therefore minimising need for adaptation equipment. The water flows from the pool output through the pump 40 and standard secondary filter 42 to the pool heater, by means of a tube. Part of the water then flows through a bypass tube 44 whereas the rest of the water flows through the body of the heater 22, between its internal (not shown) and external wall where it is heated. Both flows then recombine at the outlet and return to the pool.

Figure 2:
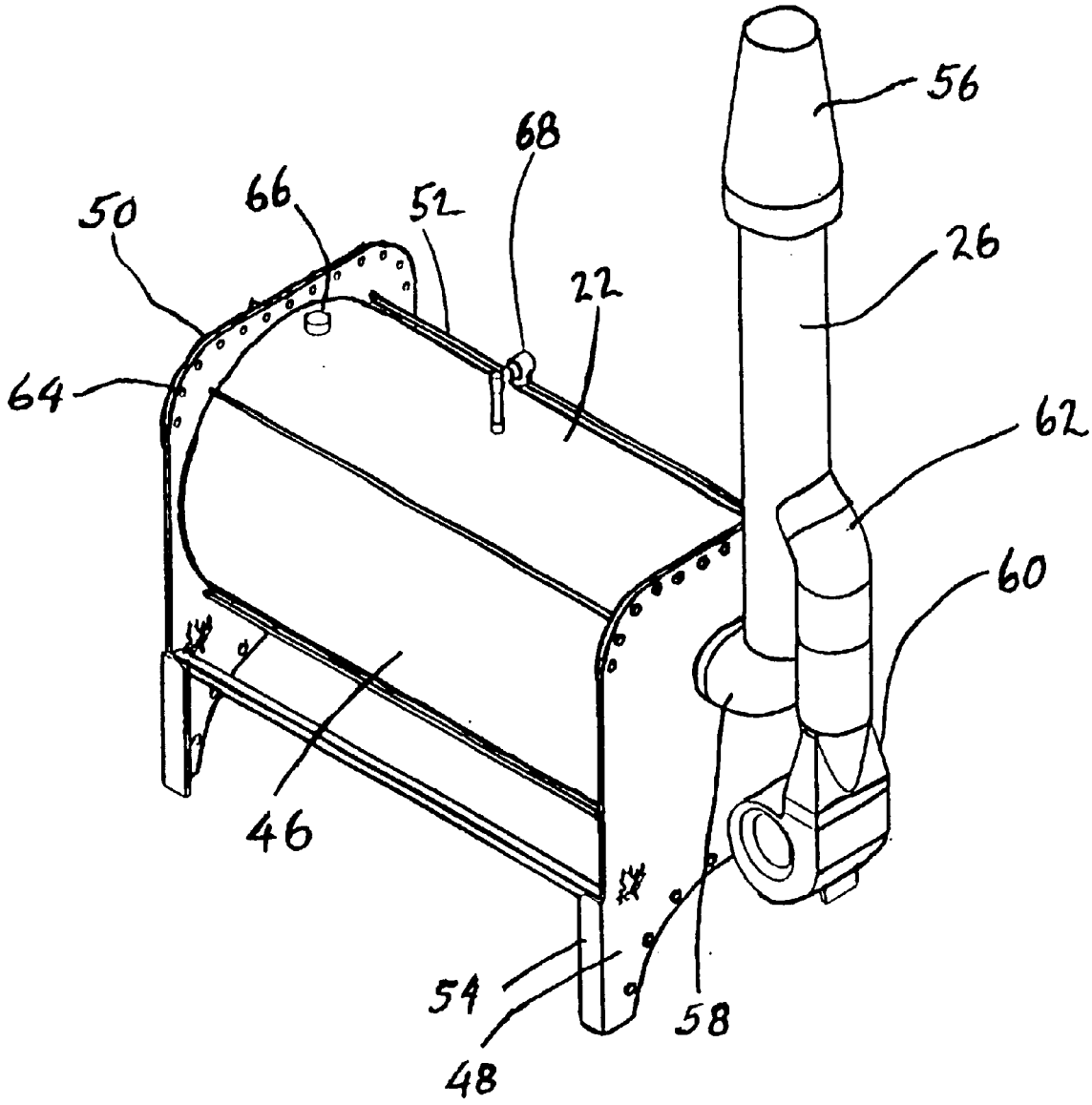
FIG. 2 is a perspective view of the pool heater seen from the back.

FIG. 2 shows the oven 22 with a cylindrical outer shell 46 even and preferably made of stainless steel. This shell is limited by two ends, a rear end 48 and a front end 50, which are held together by rods 52 and sustained by means of legs 54. A security cap 56 protects the chimney 26 from rain water and keeps sparks from coming out. An elbow 58 channels exhaust gas from the oven to the chimney, and an optionnal fan 60 with a 45° elbow 62 induces airflow in the chimney. Decoration holes 64 are also illustrated in the front and back walls. On the top of the external shell, there is an outlet 66 and a security pressure valve 68.

Figure 3:
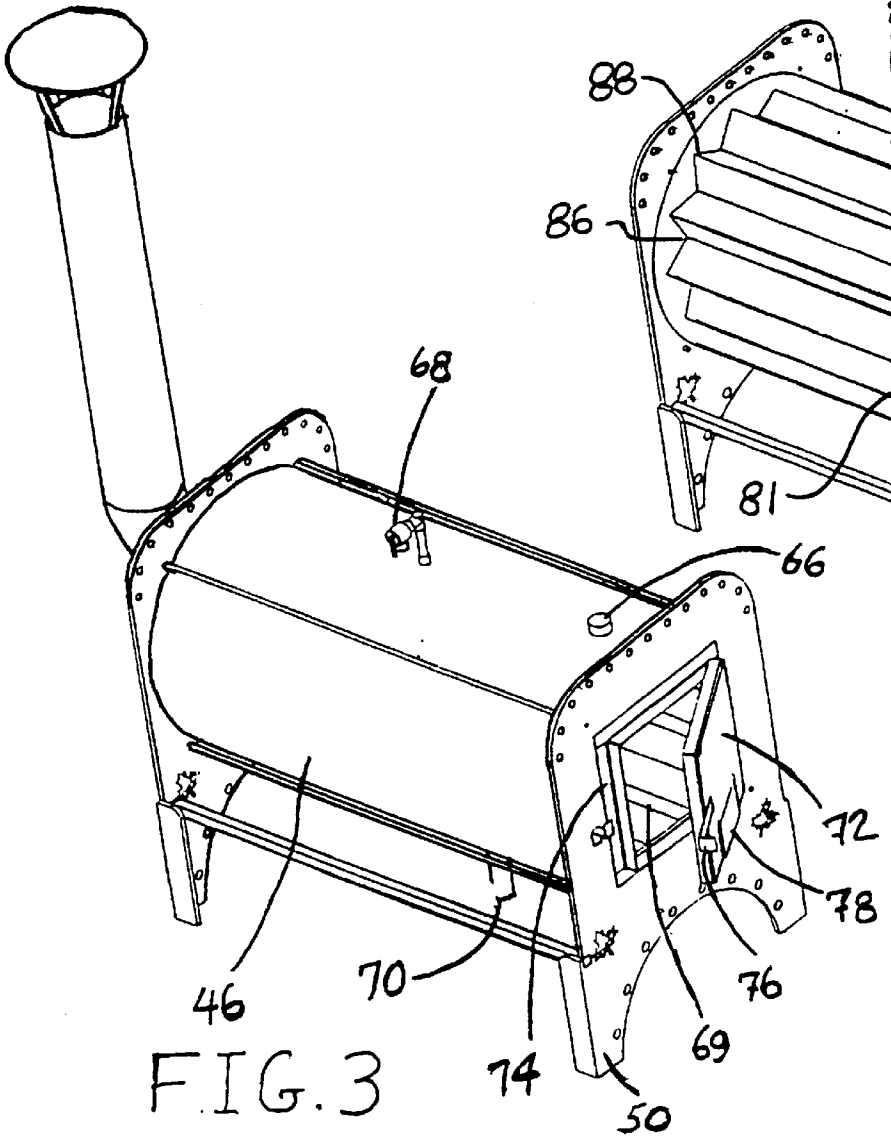
FIG. 3 is a perspective view of the pool heater seen from the front.

FIG. 3 shows particularly the fact that the external shell 46 surrounds an internal shell 69. The oven's water inlet 70 is illustrated at the bottom of the oven. In this case, the opening at the front of the oven is equipped with a door 72 held in a frame 74 by a lock 76, and with a window 78.

Figure 4:
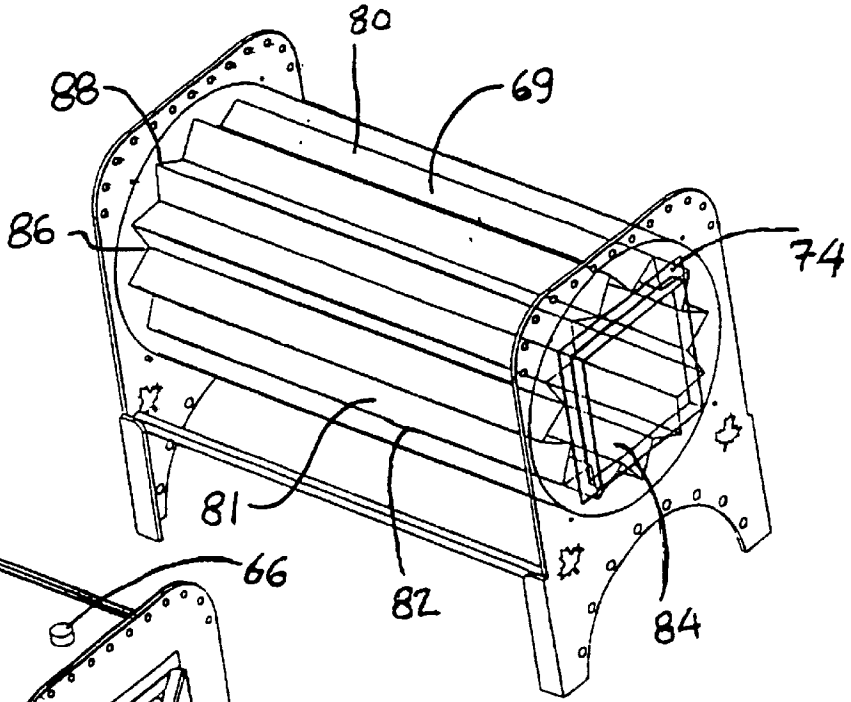
FIG. 4 is also a perspective view of the pool heater seen from the front; but in which the oven's outer shell has been removed.

FIG. 4 shows the oven of FIG. 3 without the external shell. The starlike shape of the section of the internal shell 69 is visible together with it's accordeon shaped surface 80 that is made of the shape of a staircase bended around a circumference, its section herein called star. Between the external shell and the internal shell, the heating water circulates. The surface of the internal shell forms tips 82 and valleys 81 wich form a series of pair of angles big 86 and small 88. The bottom of the internal wall forms an ash receptacle 84.

Figure 5:
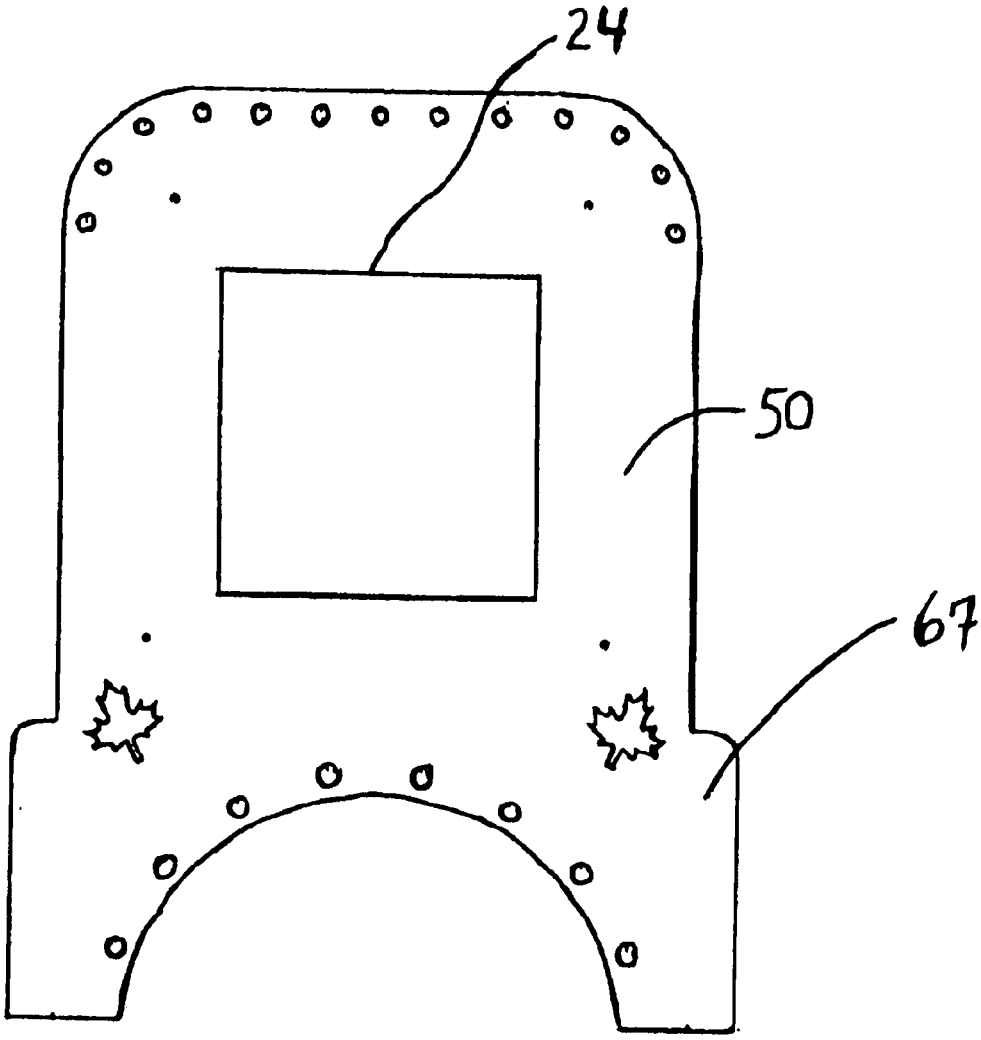
FIG. 5 is a front view.

FIG. 5 shows the front end 50 and the position of the opening 24 at the front of the oven. The front end includes front legs 67.

Figure 6:
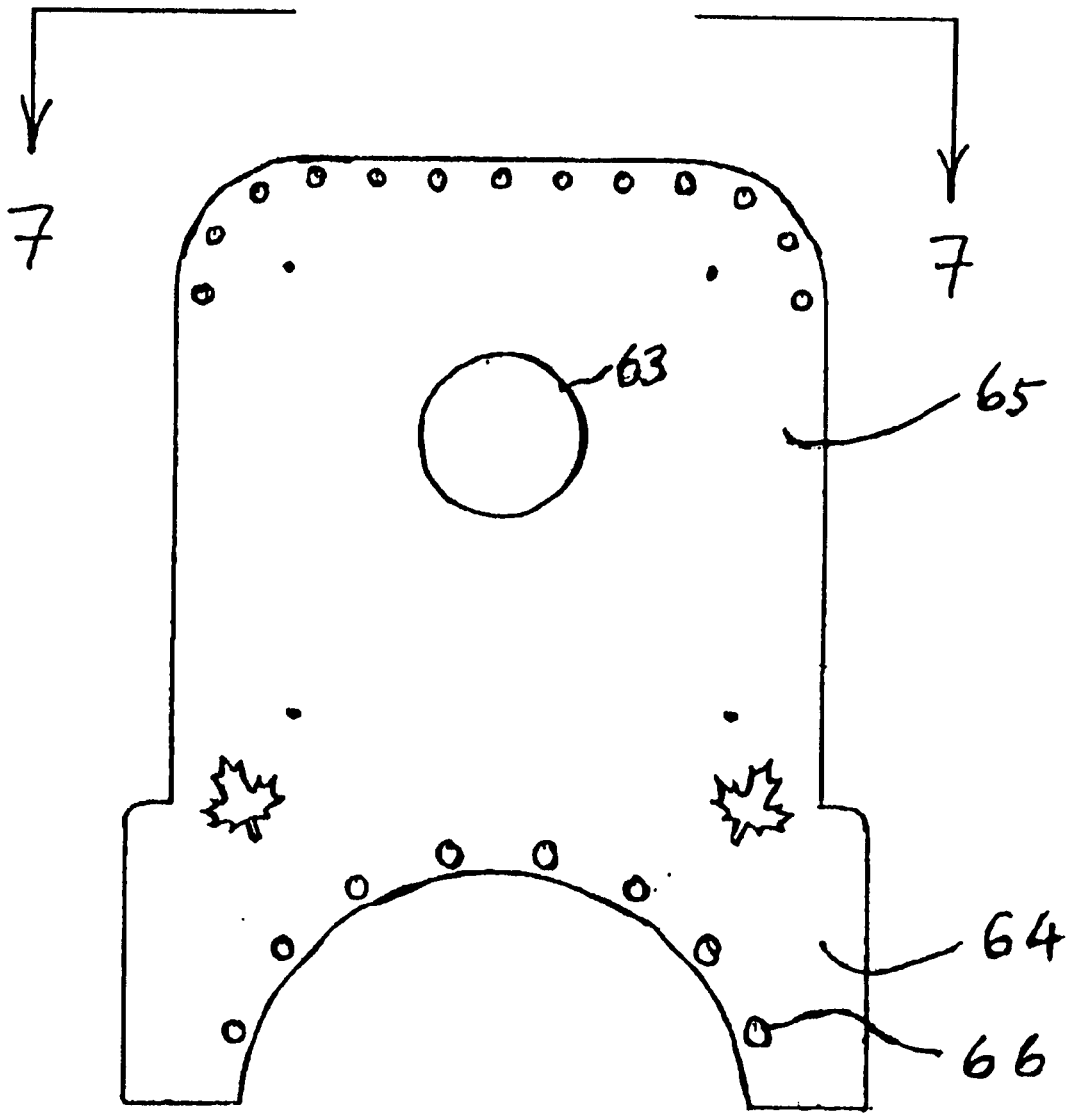
FIG. 6 is a back view.

FIG. 6 shows the rear wall 65 with an exhaust hole 63, two rear legs 64 and decorations 66.

Figure 7:
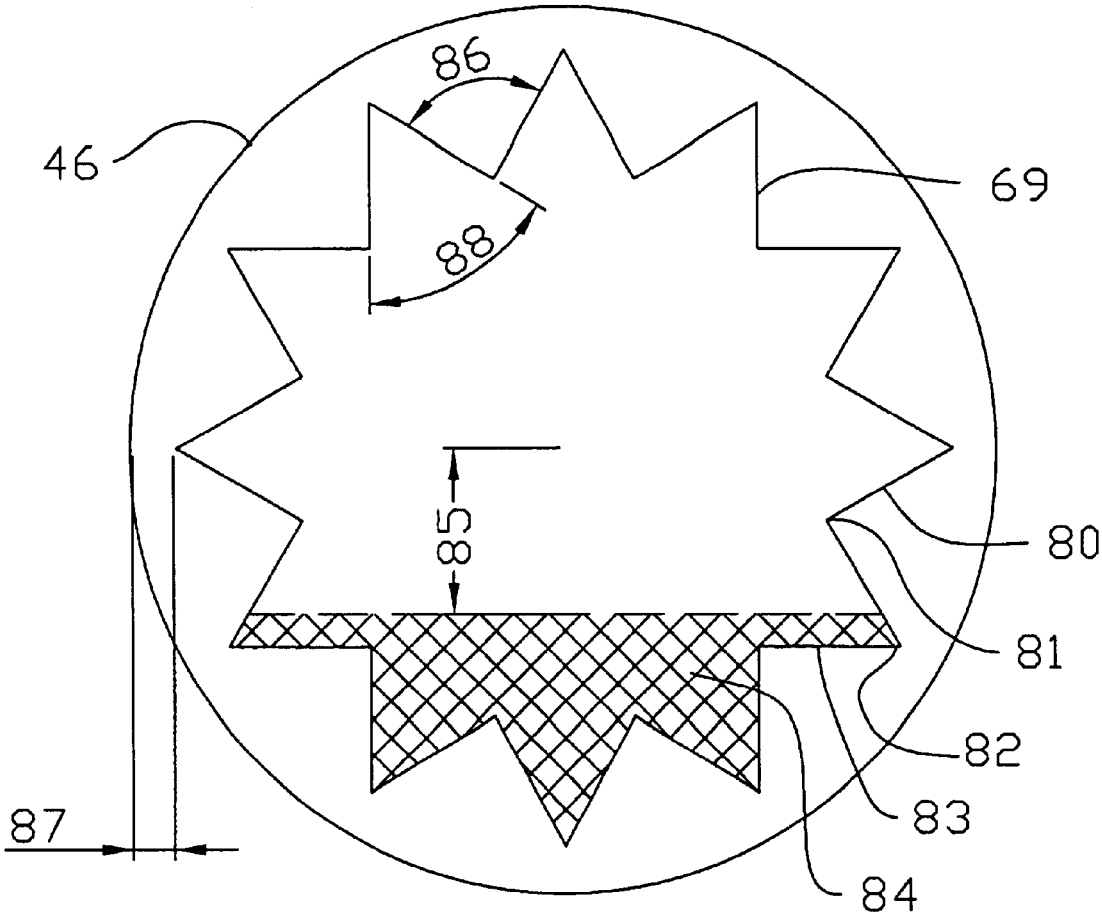
FIG. 7 shows a section of the heater defined by arrows 7—7 of FIG. 6.

FIG. 7 shows the tips 82 of the star which form the internal shell 69, in each tip interior an angle is formed and called small angle 88. Between each tip there is a valley 81 that forms a bigger angle than the previous tip interior angle, this angle is called big angle 86. This illustration shows an example of a star. It has twelve tips, the big angles are of approximately one hundred degrees whereas the small angles are of approximately seventy degrees. The distance 87 between a tip and a tangent to the external shell is of 1¼" in this case. The figure also indicates that the internal shell can accumulate ashes which are represented by the hatched section 84 and for which the distance 85 to the center may vary. Under the ashes, it is not necessary to provide a greater heat transfer surface be cause the ashes act as an insulator, hence the bottom section of the fire chamber does not contribute to heat transfer as much as side and top regions.

Figure 8:
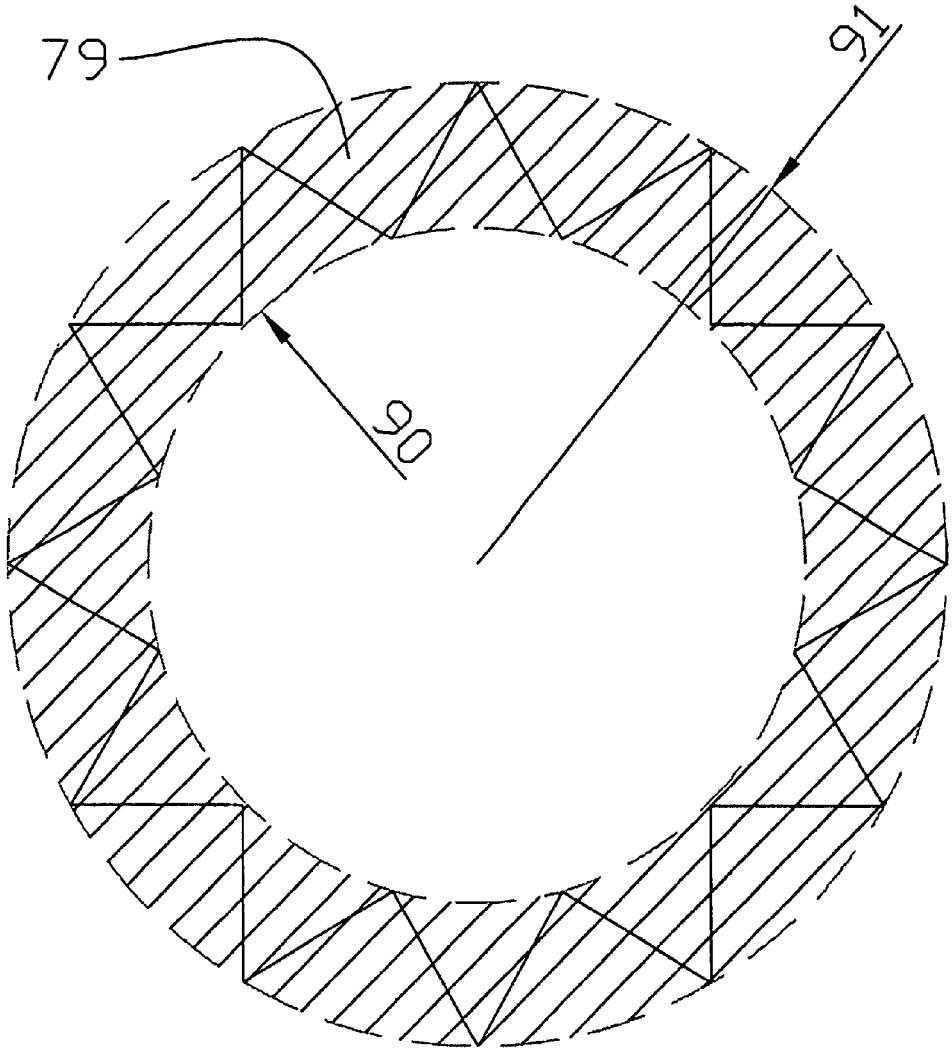
FIG. 8 illustrates the imaginary annulus which circonscribes the section of the inner shell.

FIG. 8 clarifies the fact that the section of the corrugated internal shell 69 can be circumscribed by an imaginary annulus 79 represented by the dashed section, and that this annulus is characterized by an internal radius 90 and an external radius 91. The annulus defines the region where the tips and valleys of the corrugated shell are limited, the tips and valleys form a rounded accordeon shape. The big and small angles and the value of heat exchange surface area depend on the ratio of the external versus internal radius of the annulus and on the number of tips of the star. In the illustrated case, this ratio is of approximately 10:7.

Figure 9B:
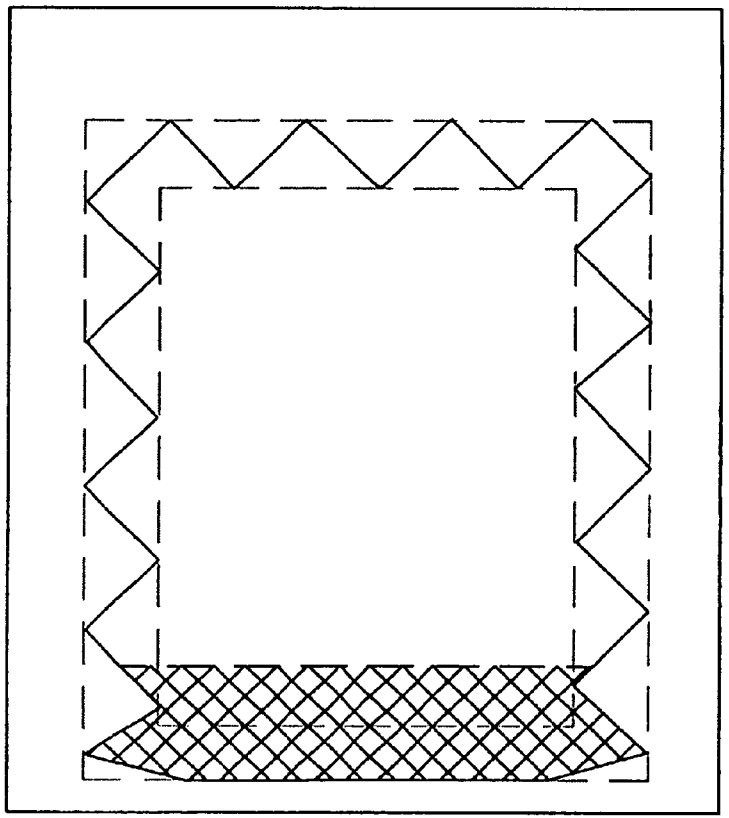
FIGS. 9A and 9B shows how the annulus identified 79 in FIG. 8 may have different shapes and sizes.
Figure 9A:
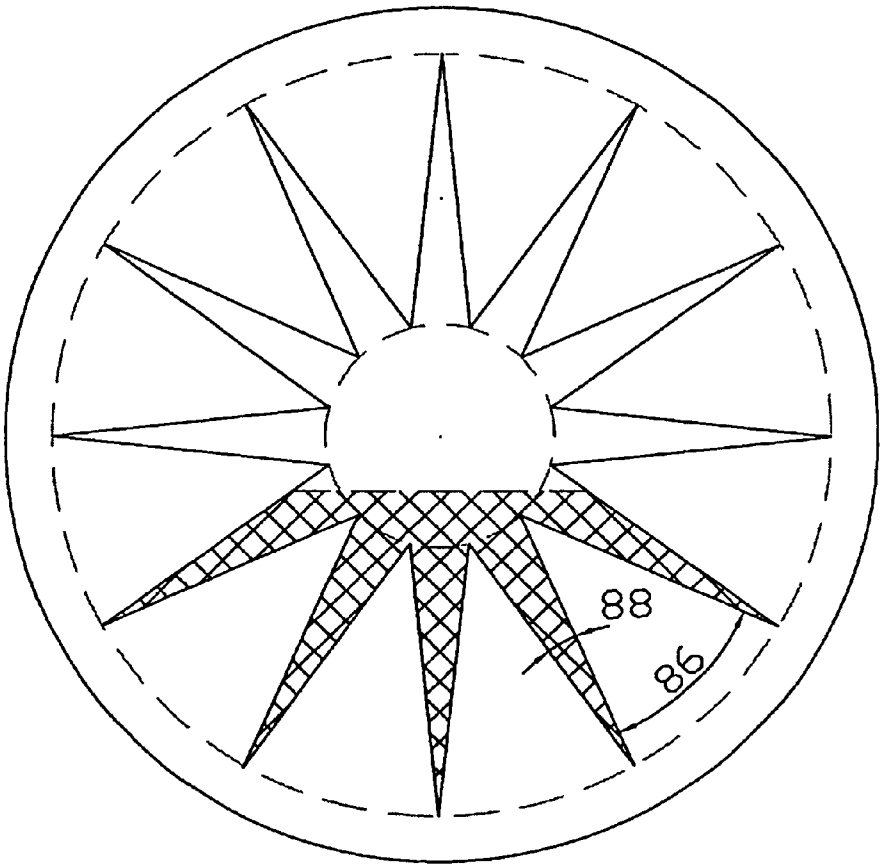

FIG. 9A, the ratio of external to internal diameter is now of approximately 10:3 and the big and small angles appear to have approximately 40 and 10 degrees respectively. Note that the number of tips of the star shape may also vary. Although an internal radius and shape like this one would not be well suited for use with wood as fuel, oil or another fuel might prove to be excellent.

FIG. 9B shows a fluid heater which uses the same principle as the one we presently study, but where the shape of the annulus has been changed to an annular rectangle. Water still flows between internal and external shell and ashes again may accumulate at the bottom of the fire chamber and provide insulation with no need for tiles. In this case, the bottom tips and valleys have been removed because they were not necessary as explained in discussion of FIG. 7. Note also that parts of the corrugated surface section may not be circumscribed by a regular region as indicated in the figure and that this region has only been added for ease of description and understanding.

Figure 10:
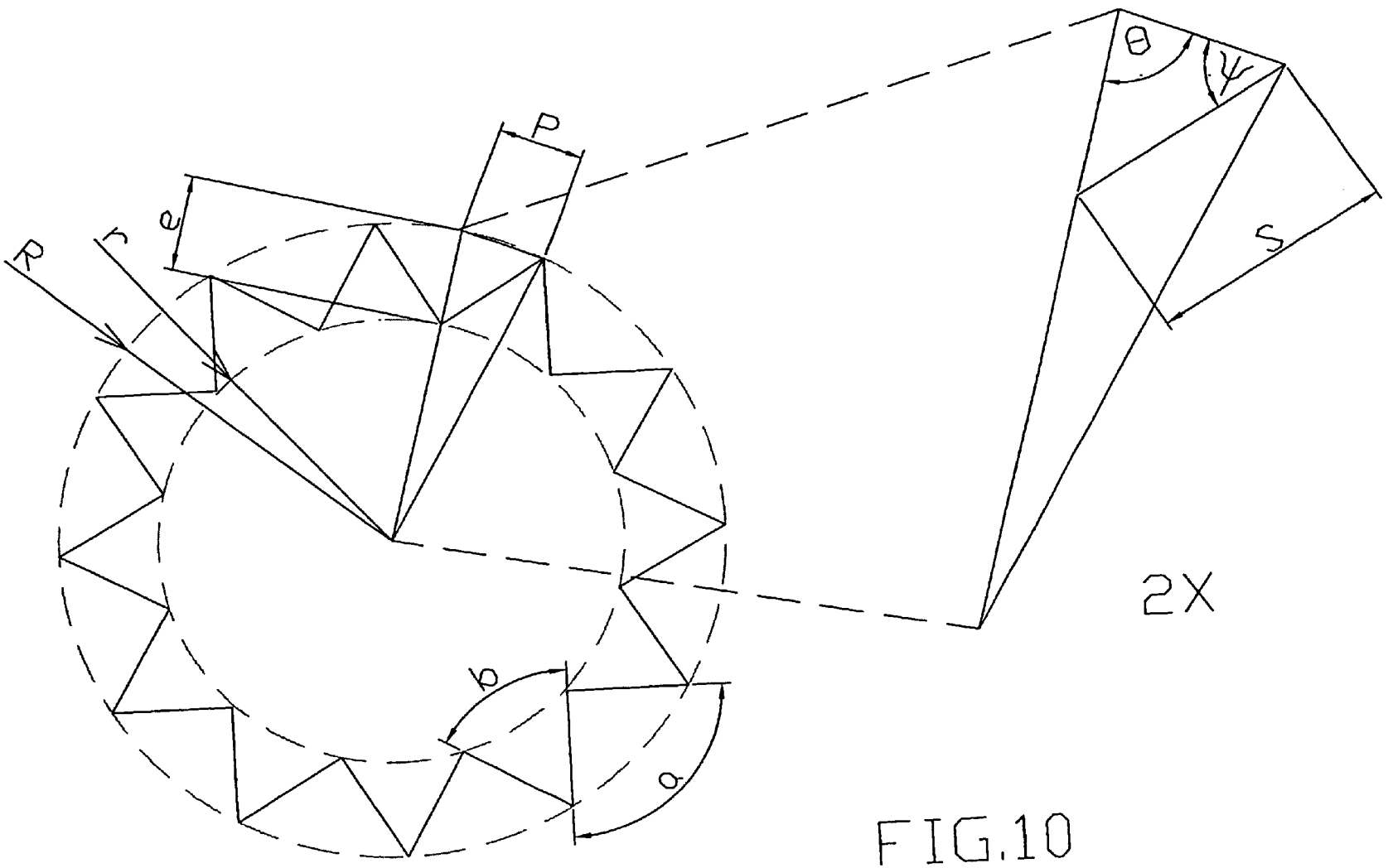
FIG. 10 is a view which permits use of the mathematical formulae included in the description of the embodiment of FIGS. 7,8,9A.

FIG. 10 is to be used for understanding calculations that may be done with mathematical formulae listed further down. In this representation of the annulus of FIG. 8, certain dimensions have been identified either by a letter of the English or the Greek alphabet. Part of the drawing has been magnified by a factor 2× and displaced from its original location along the sharp dashed lines. The reason for this is to provide increased clarity of description.

2. Summary and Ramifications

A particular objective is to provide a stainless steel water heater, stainless steel being used for its high temperature and corrosion resistance and its good thermal conductivity.

The external shell 46 is cylindrical and disposed horizontally, it may be equipped with external insulation. The internal shell 69 forms the combustion chamber wall and has a cross section which is star shaped. The internal shell is disposed horizontally, like the external shell; as seen in FIGS. 3&4. Two other surfaces, a front face and a back face enclose the volume inside the outer shell. Water flows and/or is contained in the volume delimited by these four surfaces thus forming a water tank which also acts as a conduct when water flow is activated. Hence, there are two regions inside the outer shell: the water tank, also called circulation chamber, between the outer shell and the inner shell, and the fire chamber located inside the inner shell.

The star shape of the corrugated shell cross section has a perimeter of approximately twice the value of one that would be formed by a non-corrugated cylindrical inner shell cross section. It is formed by tips and valleys between which are found segments of equal length. The star is circumscribed by an imaginary annulus having approximately 1½" width between external and internal radius. This annulus 79 is delimited by the tips 82 and valleys 81 of the star cross section. Each tip is associated to a small angle 88 and each valley is associated to a big angle 86. The difference between these angles is what creates the annulus. If both angles were equal, the corrugated cross section would define a circle of infinite radius or, in other words, a corrugated straight line.

Though the exterior of the oven is cylindrical, the internal shell is corrugated as indicated by the cross section described above and illustrated in FIGS. 7&8. The preferred annulus has a 17" external diameter, big angles 86, oriented towards the exterior, of approximately 100° and small angles 88, oriented towards the interior, of approximately 70°. Though the star shape of the preferred embodiment is regular, the bottom section designed for ash accumulation may have a non corrugated cross section because due to the insulation created by the leftover ashes from the wood combustion, the importance of a greater heat exchange surface may be neglected in this region.

Leftover ashes are used as insulation between the fire and the fire chamber wall's bottom section. This insulation replaces the tiles which are often used in such fire burning ovens.

As the preferred embodiment, the fluid to be heated is a private pool water and fuel to be used is wood.

The means for loading the fuel comprise a door 72 mounted on a frame 74, held closed with a lock 76. This door is equipped by a window through which it is possible to see the degree of activity of combustion.

Means of water circulation to and from the pool comprise of standard pool tubing 38 having 1½" diameter and the standard pool pump 40. The entry and exit from the pool being the standard pool inlet 34 and outlet 36 as indicated by FIG. 1, this minimizes the need for adaptation equipment and helps reduce cost. A typical pool filter 42 is often part of the system. The heater can be placed lower than the level of the bottom of the pool, in which case the heater pumping system can benefit from the action of gravity. A bypass can be installed parallel to the pump and comprises an activator which starts if the pump stops due to a power failure. A manual valve can be added to the parallel conduct. A security valve 68 is present at the top of the oven water tank and conduct to prevent pressure from becoming too high inside the circulation chamber. In the case of flow stop caused by power failure of the pump, while combustion is taking place within the fire chamber, the water may turn to vapor and hence be evacuated to the pool although there is no pumping taking place. At pump startup, a negative pressure may occur, which may stress the oven internal and external walls. A one-way valve may be added to the outlet or to the top of the external shell to prevent such negative pressure problems by permitting outside air to enter and fill the vacuum created.

For gas evacuation, the oven is equipped with a chimney, the pull is insured by a 7" duct approximately 8' high. The chimney can be equipped with an optional fan.

3. Calculations

In the following calculations which are concentrated on dimensions of the corrugated internal surface of the preferred embodiment, the variables identified by letters refer to measurements indicated by corresponding letters on FIG. 10.

The difference (D) between the big angle 86 (a) and the small angle 88 (b) is equal to 360 degress divided by the number (N) of tips of the star. To simplify calculations, we define an angle $\phi$: the average of angles a and b. Both the numeric value of the angle $\phi$ and the length S of the segments, which permit calculation of the total perimeter of the star shaped section and thus total heat exchange surface, are function of the internal radius diameter 90 (r), the external radius diameter 91 (R), and the number of tips N. They are related by the following equations $$\phi=(a+b)/2$$

$$b=a-D$$

$$D=360/N$$

$$a=360-2\theta-2\psi$$

$$\psi=arcsin(e^{*}\sin(\theta)/S)$$

$$e=R-r$$

$$\theta=90(1-1/N)$$

$$S=(P^2+e^2-2Pe(\cos\theta))^{1/2}$$

$$P=R(\sin(180/N))/\sin\theta$$

Where the angles are measured in degrees, e is the width of the annulus, P is the length of the line indicated in FIG. 10, and $\theta$ and $\psi$ are the angles indicated on the zoomed part of FIG. 10 (indicated by sharp dashed lines).

It is to be understood that the embodiments of this invention which were described above, in reference to the annexed drawings, were given as an indication and are by no means restrictive. Modifications and adaptations thereof can be implemented without the object deviating from the framework of this invention. Other embodiments are possible and only limited by the scope of the appended claims.

PARTS LIST

| | |
|---|---|
| 20- Pool heater | Chauffe-piscine |
| 22- Oven | Four |
| 24- Loading opening | Ouverture de chargement |
| 26- Chimney | Cheminée |
| 28- Intake tubing | Tuyau d'entrée |
| 30- Exit tubing | Tuyau de sortie |
| 32- Pool | Piscine |
| 34- Pool inlet | Entrée de piscine |
| 35- Pool top | Haut de piscine |
| 36- Pool outlet | Sortie de piscine |
| 37- Pool bottom | Fond de piscine |
| 38- Tubing | Canalisation |
| 40- Pump | Pompe |
| 42- Filter | Filtre |
| 44- Extension tubing | Tuyau d'extension |
| 46- External shell | Coquille externe |
| 48- Rear end | Extrémité arrière |
| 50- Front end | Extrémité avant |
| 52- Rods | Tiges de maintien |
| 54- Rear legs | Pattes arrière |
| 56- Security cap | Chapeau de sécurité |
| 58- Elbow | Coude |
| 60- Optionnal fan | Ventilateur optionnel |
| 62- 45° Elbow | Coude à 45° |
| 64- Decorations | Trous de décoration |
| 65- Back wall | Mur arrière |
| 66- Outlet | Bouchon de sortie |
| 67- Front legs | Pattes avant |
| 68- Security valve | Soupape de sécurité |
| 69- Internal shell | Coquille intérieure |
| 70- Water inlet | Prise d'eau |
| 72- Door | Porte |
| 74- Frame | Cadre |
| 76- Lock | Loquet |

-continued

PARTS LIST

| | |
|---|---|
| 78- Window | Lunette |
| 79- Annulus | Anneau |
| 80- Corrugated surface | Paroi ondulée |
| 81- Valley | Creux |
| 82- Tips | Crêtes |
| 83- Segment | Segment |
| 84- Ash receptacle | Réceptacle à cendres |
| 85- Ash distance | Distance cendres |
| 86- Big angle | Grand dilaté |
| 87- Tip distance | Distance de pointe |
| 88- Small angle | Petit angle |
| 90- Internal radius | Rayon interne |
| 91- External radius | Rayon externe |

I claim:

1. A water heater comprising:

a generally cylindrical, horizontally disposed external enclosure, a corrugated internal enclosure located concentrically within said external enclosure, said internal enclosure forming a combustion chamber, said corrugations increasing said internal enclosure surface area by a factor 1.3 to 5 by comparison to a smooth cylindrical wall of the external enclosure type, a region between said external and said internal enclosures defining a circulation chamber, wherein water may circulate and absorb heat from said combustion chamber, said circulation chamber comprising a water inlet for supplying water into said circulation chamber and a water outlet for channelling water out of said circulation chamber, said outlet being disposed oppositely to said inlet in order to optimize water displacement within said circulation chamber, said internal enclosure surface area increase thus maximizing heat transfer from said combustion chamber to said circulation chamber, a rear face and a front face, disposed oppositely one to the other at each end of said external enclosure, a door in said front face for inserting a fuel like wood into said combustion chamber, means for exhausting combustion fumes from said combustion chamber, means for channelling water from and towards a region of use.

2. The fluid heater claimed in claim 1, wherein a certain portion of said tips and valleys forming a corrugated shape are covered by ashes towards the bottom of said internal wall cross section thus creating an ash receptacle.

3. The fluid heater claimed in claim 1, used to heat a pool, wherein said fuel is wood, wherein said means for evacuating gases comprise a chimney disposed upwardly against said external enclosure, and wherein said means to channel water from and to said region of use comprise of a pool filter system comprising a pump, a filter, and tubing, with tubing joining said filter to said water inlet, and tubing joining said water outlet to said pool, said pump channelling water through said tubing, from pool, through filter, through water heater, and back to pool.

4. The fluid heater of claim 1, wherein said means for supplying water into said circulation chamber comprise a standard pump of the type that is usually installed with a primary filter common to most pool filtration systems, and tubing linking said pump to said circulation chamber.

* * * * *